US008020552B2

(12) United States Patent
Dillon et al.

(10) Patent No.: US 8,020,552 B2
(45) Date of Patent: Sep. 20, 2011

(54) HELMETS AND METHODS OF MAKING AND USING THE SAME

(75) Inventors: Mark S. Dillon, Columbus, MS (US); Youzhen Ding, Alpharetta, GA (US)

(73) Assignee: Microtek Medical, Inc., St. Paul, MN (US)

( * ) Notice: Subject to any disclaimer, the term of this patent is extended or adjusted under 35 U.S.C. 154(b) by 1045 days.

(21) Appl. No.: 11/710,699

(22) Filed: Feb. 26, 2007

(65) Prior Publication Data

US 2008/0202509 A1 Aug. 28, 2008

(51) Int. Cl.
*A62B 18/00* (2006.01)
*A62B 18/04* (2006.01)
*A42B 3/00* (2006.01)

(52) U.S. Cl. ..... 128/201.24; 128/201.22; 128/201.23; 128/201.29; 128/204.18; 128/204.21; 2/410; 2/456; 2/457

(58) Field of Classification Search ..... 128/201.24, 128/857, 201.22, 201.23, 201.25, 201.29, 128/204.18, 205.27, 205.28, 206.16, 206.19
See application file for complete search history.

(56) References Cited

U.S. PATENT DOCUMENTS

| | | | | |
|---|---|---|---|---|
| 1,800,051 | A | | 4/1931 | Blanco |
| 2,296,338 | A | | 9/1942 | Dakin |
| 2,390,352 | A | | 12/1945 | Bouchard |
| 2,436,249 | A | | 2/1948 | Clement |
| 2,579,942 | A | | 12/1951 | MacLean |
| 2,641,768 | A | | 6/1953 | Pipher |
| 3,098,233 | A | | 7/1963 | Hoagland |
| 3,458,864 | A | | 8/1969 | Austin et al. |
| 3,529,594 | A | | 9/1970 | Charnley |
| 3,660,850 | A | | 5/1972 | Garbisch |
| 3,668,705 | A | | 6/1972 | Garbisch |
| 3,885,558 | A | | 5/1975 | Belkin |
| 3,911,914 | A | | 10/1975 | Johansson |
| 3,943,575 | A | | 3/1976 | Bolker |
| 3,955,570 | A | | 5/1976 | Hutter, III |
| 3,963,021 | A | * | 6/1976 | Bancroft ..... 128/201.25 |
| 3,990,112 | A | | 11/1976 | Cliffolillo |
| 4,019,508 | A | | 4/1977 | Der Estephanian et al. |
| 4,127,130 | A | | 11/1978 | Naysmith |
| 4,172,294 | A | | 10/1979 | Harris |
| 4,280,491 | A | * | 7/1981 | Berg et al. ..... 128/201.24 |
| 4,451,933 | A | | 6/1984 | Seng et al. |
| 4,455,687 | A | | 6/1984 | Johansson |
| 4,458,680 | A | | 7/1984 | Childers et al. |
| 4,577,348 | A | | 3/1986 | Hoffmann |
| 4,589,408 | A | | 5/1986 | Singer |

(Continued)

FOREIGN PATENT DOCUMENTS

WO WO 2004084665 A2 * 10/2004

*Primary Examiner* — Justine Yu
*Assistant Examiner* — Clinton T Ostrup
(74) *Attorney, Agent, or Firm* — Andrew D. Sorensen; Laura C. DiLorenzo

(57) ABSTRACT

The present invention is directed to a helmet suitable for use in an operating room setting, an emergency room setting, a hospital setting, or a lab. The helmet of the present invention provides one or more of the following features: (i) superior barrier protection to a surgeon (or other operating room personnel) during a surgical procedure, (ii) a desired degree of air flow through the helmet so as to minimize the potential for carbon dioxide buildup within the helmet, and (iii) an integrated battery pack positioned within the helmet.

18 Claims, 8 Drawing Sheets

U.S. PATENT DOCUMENTS 4,619,254 A 10/1986 Moretti et al.
4,719,462 A 1/1988 Hawkins
4,848,366 A 7/1989 Aita et al.
4,901,716 A * 2/1990 Stackhouse et al. ..... 128/201.25
4,945,574 A 8/1990 Dagher
5,005,216 A 4/1991 Blackburn et al.
5,009,225 A 4/1991 Virabel
5,025,507 A 6/1991 Kirby
5,042,474 A 8/1991 Williamson
5,046,492 A * 9/1991 Stackhouse et al. ..... 128/200.27
5,054,480 A 10/1991 Bare et al.
5,091,996 A 3/1992 Kirby
5,113,853 A * 5/1992 Dickey ..... 128/200.28
5,125,402 A * 6/1992 Greenough ..... 128/201.25
5,140,980 A 8/1992 Haughey et al.
5,142,704 A 9/1992 Viemeister et al.
5,253,642 A 10/1993 Stackhouse et al.
5,283,914 A * 2/1994 James ..... 2/424
5,452,712 A 9/1995 Richardson
D366,347 S 1/1996 Avey
5,577,495 A * 11/1996 Murphy ..... 128/201.24
5,588,153 A 12/1996 Ignon et al.
5,592,936 A 1/1997 Thomas, Jr. et al.
5,711,033 A 1/1998 Green et al.
5,724,958 A 3/1998 Farnworth et al.
5,839,432 A 11/1998 Daneshvar
5,887,281 A 3/1999 Green et al.
5,937,445 A 8/1999 Ravo et al.
6,370,695 B2 4/2002 Paris et al.
6,374,823 B1 4/2002 Hajianpour
6,393,617 B1 5/2002 Paris et al.
6,481,019 B2 11/2002 Diaz et al.
6,513,168 B2 2/2003 Paris et al.
6,622,311 B2 9/2003 Diaz et al.
6,681,765 B2 1/2004 Wen
6,711,748 B2 * 3/2004 Paris et al. ..... 2/171.3
6,752,146 B1 * 6/2004 Altshuler et al. ..... 128/201.25
6,763,835 B1 7/2004 Grove et al.
6,834,646 B2 12/2004 Alon et al.
6,918,141 B2 7/2005 Green et al.
6,990,691 B2 1/2006 Klotz et al.
7,104,264 B2 9/2006 Lee et al.
7,192,151 B2 3/2007 Clupper et al.
7,200,873 B2 4/2007 Klotz et al.
2001/0052144 A1 12/2001 Paris et al.
2003/0182710 A1 10/2003 Klotz
2004/0216736 A1 11/2004 Lee et al.
2005/0193472 A1 9/2005 Courtney et al.
2006/0048776 A1 3/2006 Cunningham et al.
2007/0044800 A1 * 3/2007 Church et al. ..... 128/205.29
2007/0151002 A1 7/2007 Klotz et al.

* cited by examiner

HELMETS AND METHODS OF MAKING AND USING THE SAME

FIELD OF THE INVENTION

The present invention relates generally to helmets suitable for use in an operating room setting, methods of making helmets, and methods of using helmets, for example, in an operating room setting.

BACKGROUND OF THE INVENTION

A variety of disposable and reusable helmets are used in operating rooms. Helmets are used to protect and/or cover a surgeon or other operating room personnel such as during a surgical procedure. During surgical procedures, it is important for a helmet to provide a barrier between the surgeon (or other operating room personnel) and the patient so as to protect the surgeon (or other operating room personnel) from exposure to body fluids and any other contaminants. Efforts continue in the design of helmets to further enhance the properties and characteristics of helmets.

There is a need in the art for helmets that (i) are suitable for use in an operating room setting, (ii) provide superior barrier protection to a surgeon (or other operating room personnel) during a surgical procedure, (iii) provide a desired degree of air flow through the helmet so as to minimize the potential for carbon dioxide buildup within the helmet, (iv) are designed to be easily operational, (v) are designed without a separate battery pack and wires for connect the separate battery pack to the fan of the helmet, or (vi) any combination of items (i) to (v).

SUMMARY OF THE INVENTION

The present invention is directed to a helmet suitable for use in an operating room setting, an emergency room setting, a hospital setting, or a lab. The helmet of the present invention provides one or more of the following features: (i) superior barrier protection to a surgeon (or other operating room personnel) during a surgical procedure, (ii) a desired degree of air flow through the helmet so as to minimize the potential for carbon dioxide buildup within the helmet, and (iii) an integrated battery pack positioned within the helmet.

According to one exemplary embodiment of the present invention, the helmet comprises a frame operatively adapted to surround at least a portion of a person's head; a transparent face shield attached to the frame and positioned along a front side of the helmet; an air channel having at least one air inlet and at least one air outlet, the at least one air outlet being positioned so as to provide air to a space bound by an inner surface of the transparent face shield; a fan in fluid communication with the air channel, the fan being operatively adapted to move air through the air channel; a battery pack attached to the frame and positioned above a lower edge of the transparent face shield, the battery pack being operatively adapted to supply electrical power to the fan; and a hood surrounding the transparent face shield and extending over and downward from the frame.

According to a further exemplary embodiment of the present invention, the helmet comprises a frame operatively adapted to surround at least a portion of a person's head; a transparent face shield attached to the frame and positioned along a front side of the helmet; an air channel having at least one air inlet and at least one air outlet, the at least one air outlet being positioned so as to provide air to a space bound by an inner surface of the transparent face shield; a fan in fluid communication with the air channel, the fan being operatively adapted to move air through the air channel; a hood surrounding the transparent face shield and extending over and downward from the frame; at least one hood air inlet located within a periphery of the hood and aligned with the at least one air inlet of the air channel; and at least one hood air outlet located within a periphery of the hood, wherein the at least one hood air inlet and the at least one hood air outlet are operatively adapted to provide air flow through the helmet so as to decrease an amount of carbon dioxide buildup within the helmet.

The present invention is also directed to a surgical outfit comprising at least one helmet. In one exemplary embodiment, the surgical outfit comprises a helmet, and a surgical gown sized so as to extend from a neck region of a user to a waist region or below, wherein the hood of the helmet is sized so as to extend below the neck region of the user, and when a lower portion of the hood is tucked within an upper portion of the surgical gown, the at least one air outlet of the hood, when present, is positioned above the surgical gown. In this embodiment, the helmet may comprise (i) a hood comprising at least one air outlet, (ii) a battery pack attached to the frame of the helmet and positioned above a lower edge of a transparent face shield of the helmet, or (iii) both (i) and (ii).

The present invention is further directed to methods of making a helmet such as a helmet suitable for use in an operating room setting. In one exemplary embodiment of the present invention, the method of making a helmet comprises providing a frame of a helmet, the frame being operatively adapted to surround at least a portion of a person's head; attaching a transparent face shield to the frame so as to be positioned along a front side of the helmet; providing an air channel having at least one air inlet and at least one air outlet, the at least one air outlet being positioned so as to provide air to a space bound by an inner surface of the transparent face shield, the air channel being attached to or integrally formed into the frame; providing a fan in fluid communication with the air channel, the fan being operatively adapted to move air through the air channel; incorporating a battery pack into the helmet so as to be positioned above a lower edge of the transparent face shield, the battery pack being operatively adapted to supply electrical power to the fan; and providing a hood that surrounds the transparent face shield and extends over and downward from the frame.

In a further exemplary embodiment of the present invention, the method of making a helmet comprises providing a frame of a helmet, the frame being operatively adapted to surround at least a portion of a person's head; attaching a transparent face shield to the frame so as to be positioned along a front side of the helmet; providing an air channel having at least one air inlet and at least one air outlet, the at least one air outlet being positioned so as to provide air to a space bound by an inner surface of the transparent face shield, the air channel being attached to or integrally formed into the frame; providing a fan in fluid communication with the air channel, the fan being operatively adapted to move air through the air channel; and attaching a hood to the frame so as to surround the transparent face shield and extend over and downward from the frame, the hood comprising (i) at least one hood air inlet located within a periphery of the hood and aligned with the at least one air inlet of the air channel, and (ii) at least one hood air outlet located within a periphery of the hood, wherein the at least one hood air inlet and the at least one hood air outlet are operatively adapted to provide air flow through the helmet so as to decrease an amount of carbon dioxide buildup within the helmet.

The present invention is even further directed to methods of using a helmet in an operating room setting. In one exemplary embodiment of the present invention, the method comprises providing a helmet such as one of the above-described helmets; and cutting on the fan to provide an air flow path from into the at least one hood air inlet, to the at least one air inlet, through the air channel, out of the at least one air outlet into a region of the helmet bound by the transparent face shield, and out of the helmet through the at least one hood air outlet.

The present invention is even further directed to methods of reducing an amount of carbon dioxide within a surgical outfit during use. In one exemplary embodiment, the method comprises providing a surgical outfit of the present invention (such as the above-described surgical outfit or any surgical outfit described below), and cutting on the fan to provide an air flow path through an air inlet in a surgical gown, at least one hood air inlet in a helmet, to at least one air inlet, through an air channel, out of at least one air outlet into a region of the helmet bound by a transparent face shield, out of the helmet through at least one hood air outlet, and out of the surgical gown through at least one air outlet in the surgical gown. The surgical outfit of the present invention is capable of reducing an amount of carbon dioxide within the surgical outfit during use to below about 2500 ppm, and even below about 1800 ppm.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

Figure 1:
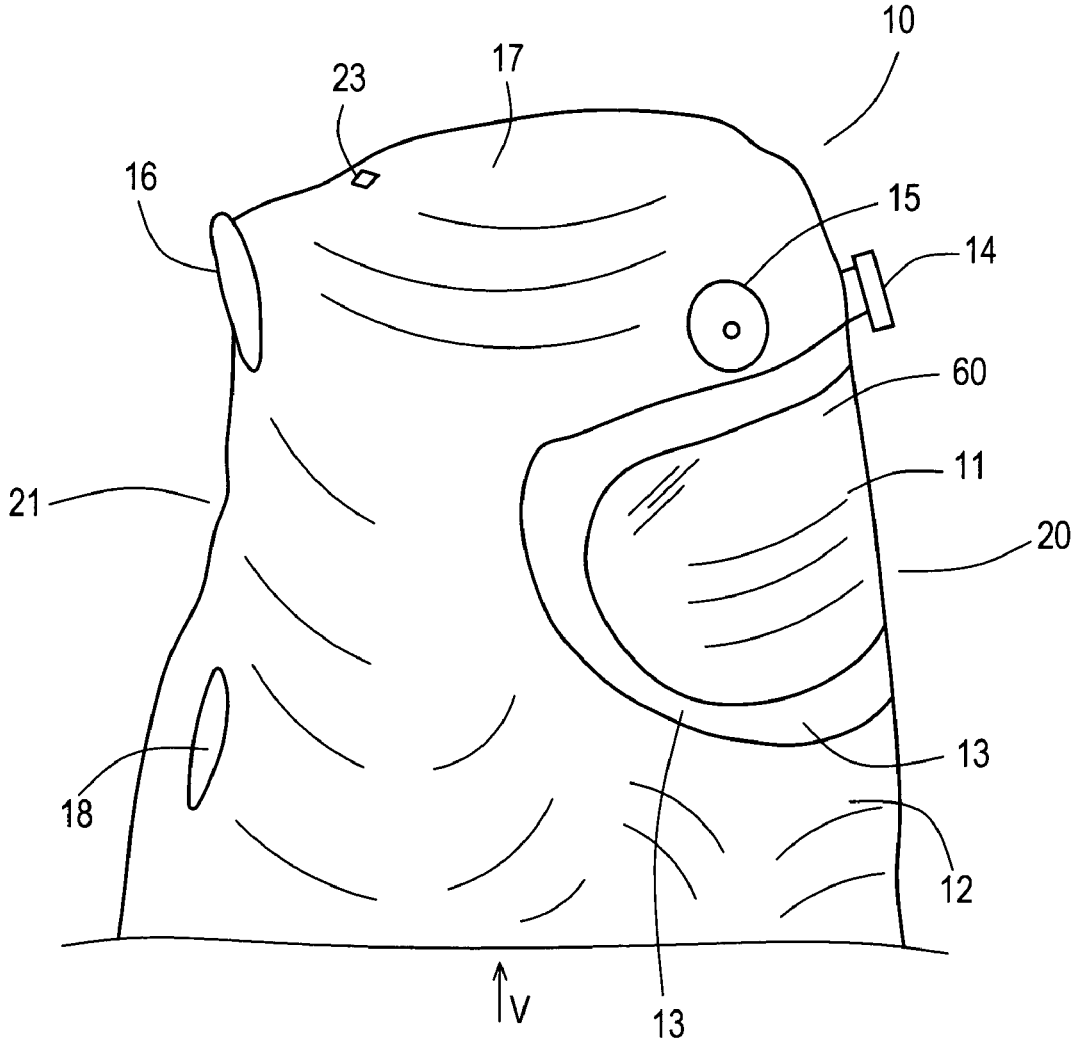
FIG. 1 depicts a side view of an exemplary helmet of the present invention.

The present invention is directed to helmets suitable for use in any environment in which a helmet is typically used including, but not limited to, an operating room setting, an emergency room setting, a hospital setting, a lab, a clean room, etc. The present invention is further directed to methods of making helmets and using helmets in an operating room setting or any of the above-mentioned environments. The helmets of the present invention are particularly useful in providing a barrier between a surgeon and a surgical site of a patient.

In one exemplary embodiment of the present invention, the helmet comprises a frame operatively adapted to surround at least a portion of a person's head; a transparent face shield attached to the frame and positioned along a front side of the helmet; an air channel having at least one air inlet and at least one air outlet, the at least one air outlet being positioned so as to provide air to a space bound by an inner surface of the transparent face shield; a fan in fluid communication with the air channel, the fan being operatively adapted to move air through the air channel; a hood surrounding the transparent face shield and extending over and downward from the frame; at least one hood air inlet located within a periphery of the hood and aligned with the at least one air inlet of the air channel; and at least one hood air outlet located within a periphery of the hood, wherein the at least one hood air inlet and the at least one hood air outlet are operatively adapted to provide air flow through the helmet so as to decrease an amount of carbon dioxide buildup within the helmet.

In other exemplary embodiments of the present invention, the helmet comprises a frame operatively adapted to surround at least a portion of a person's head; a transparent face shield attached to the frame and positioned along a front side of the helmet; an air channel having at least one air inlet and at least one air outlet, the at least one air outlet being positioned so as to provide air to a space bound by an inner surface of the transparent face shield; a fan in fluid communication with the air channel, the fan being operatively adapted to move air through the air channel; a battery pack attached to the frame and positioned above a lower edge of the transparent face shield, the battery pack being operatively adapted to supply electrical power to the fan; and a hood surrounding the transparent face shield and extending over and downward from the frame.

In yet other exemplary embodiments of the present invention, the helmet comprises a frame operatively adapted to surround at least a portion of a person's head; a transparent face shield attached to the frame and positioned along a front side of the helmet; an air channel having at least one air inlet and at least one air outlet, the at least one air outlet being positioned so as to provide air to a space bound by an inner surface of the transparent face shield; a fan in fluid communication with the air channel, the fan being operatively adapted to move air through the air channel; a battery pack attached to the frame and positioned above a lower edge of the transparent face shield, the battery pack being operatively adapted to supply electrical power to the fan; a hood surrounding the transparent face shield and extending over and downward from the frame; at least one hood air inlet located within a periphery of the hood and aligned with the at least one air inlet of the air channel; and at least one hood air outlet located within a periphery of the hood, wherein the at least one hood air inlet and the at least one hood air outlet are operatively adapted to provide air flow through the helmet so as to decrease an amount of carbon dioxide buildup within the helmet. An exemplary helmet 10 having the above features is shown in FIG. 1.

As shown in FIG. 1, exemplary helmet 10 comprises a transparent face shield 11 along a front side 20 of helmet 10, and a hood 12 surrounding an outer periphery 13 of transparent face shield 11 and extending over and downward from a frame of helmet 10 (e.g., frame 31 shown in FIG. 6 below). Exemplary helmet 10 further comprises knobs 14 and 15 that can be used to adjust the dimensions of the frame so as to better fit onto the head of a user. Knob 14 can be used to adjust a length (i.e., a first dimension extending from front side 20 to rear side 21) and a width of the frame (i.e., a dimension extending perpendicular to the first dimension, e.g., across transparent face shield 11). Knob 15 can be used to adjust a damper positioned within a vicinity of an air outlet into the helmet. (See, for example, damper 72 in FIG. 5, which is shown in an "up" position, but can be rotated into a "down" position away from wall 73 of second frame component 33 to block air flow coming out of air outlet 28.)

Exemplary helmet 10 further comprises an air channel air channel extending along upper region 17 of helmet 10 and having at least one air inlet (e.g., air inlet 22 shown in FIG. 2) and at least one air outlet (e.g., air outlet 28 shown in FIG. 4), wherein the at least one air outlet is positioned so as to provide air to a space 60 bound by an inner surface of transparent face shield 11. A fan (e.g., fan 27 shown in FIG. 4 below) is in fluid communication with the air channel, and is operatively adapted to move air through the air channel.

As shown in FIG. 1, in some desired embodiments of the present invention, exemplary hood 12 of exemplary helmet 10 comprises (i) at least one hood air inlet 16 located within a periphery of hood 12 and aligned with the at least one air inlet (e.g., air inlet 22 shown in FIG. 2) of the air channel, and (ii) at least one hood air outlet 18 located within a periphery of hood 12. Hood air inlet 16 and hood air outlet 18 are operatively adapted to provide air flow through helmet 10 so as to decrease an amount of carbon dioxide buildup within helmet 10. Desirably, hood air inlet(s) 16 and hood air outlet(s) 18 are positioned along a rear side 21 of helmet 10 opposite transparent face shield 11 (see, for example, FIG. 2); however, it should be understood that hood air inlet(s) 16 and hood air outlet(s) 18 may be positioned along any location of helmet 10 as long as hood air inlet(s) 16 and hood air outlet(s) 18 provide air flow through helmet 10 so as to decrease an amount of carbon dioxide buildup within helmet 10.

Figure 2:
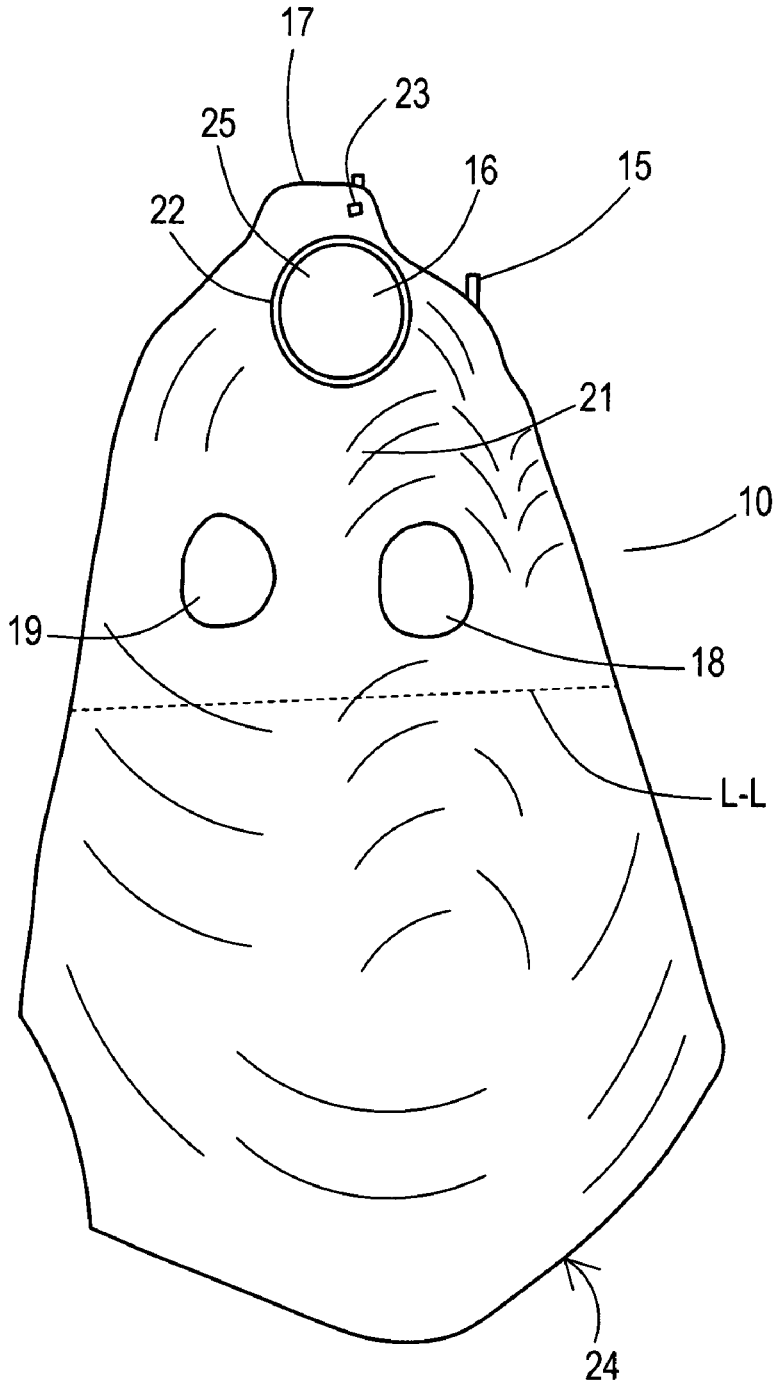
FIG. 2 depicts a rear view of the exemplary helmet of FIG. 1.

FIG. 2 provides a rear view of exemplary helmet 10. As shown in FIG. 2, exemplary hood 12 of exemplary helmet 10 comprises (i) a single hood air inlet 16 located within a periphery of hood 12, and (ii) two substantially similar hood air outlets 18 and 19 located within a periphery of hood 12, below hood air inlet 16, and positioned side-by-side along a neck region of hood 12. As shown in FIG. 2, hood air inlet 16 is located within a periphery of the hood and aligned with air inlet 22 of air channel 25. Hood air outlets 18 and 19 are located within a periphery of the hood, and positioned below hood air inlet 16. In this exemplary embodiment, air enters helmet 10 at a position above a user's head, and exits helmet 10 along a neck region of the user as designated by dashed line L-L. Exemplary hood 12 extends below dashed line L-L to lower edge 24 of hood 12.

In the exemplary embodiment of FIG. 2, exemplary helmet 10 comprises a power switch 23 positioned along upper region 17 of helmet 10. Power switch 23 is operatively adapted to switch from an "off" position to an "on" position so as to supply power to the fan (e.g., fan 27 shown in FIG. 4 below) and turn off power to the fan. In other exemplary embodiments, power switch 23 is provided in other locations such as a position along an upper periphery of transparent face shield 11 (see, for example, power switch 23 shown in FIG. 6).

Figure 3:
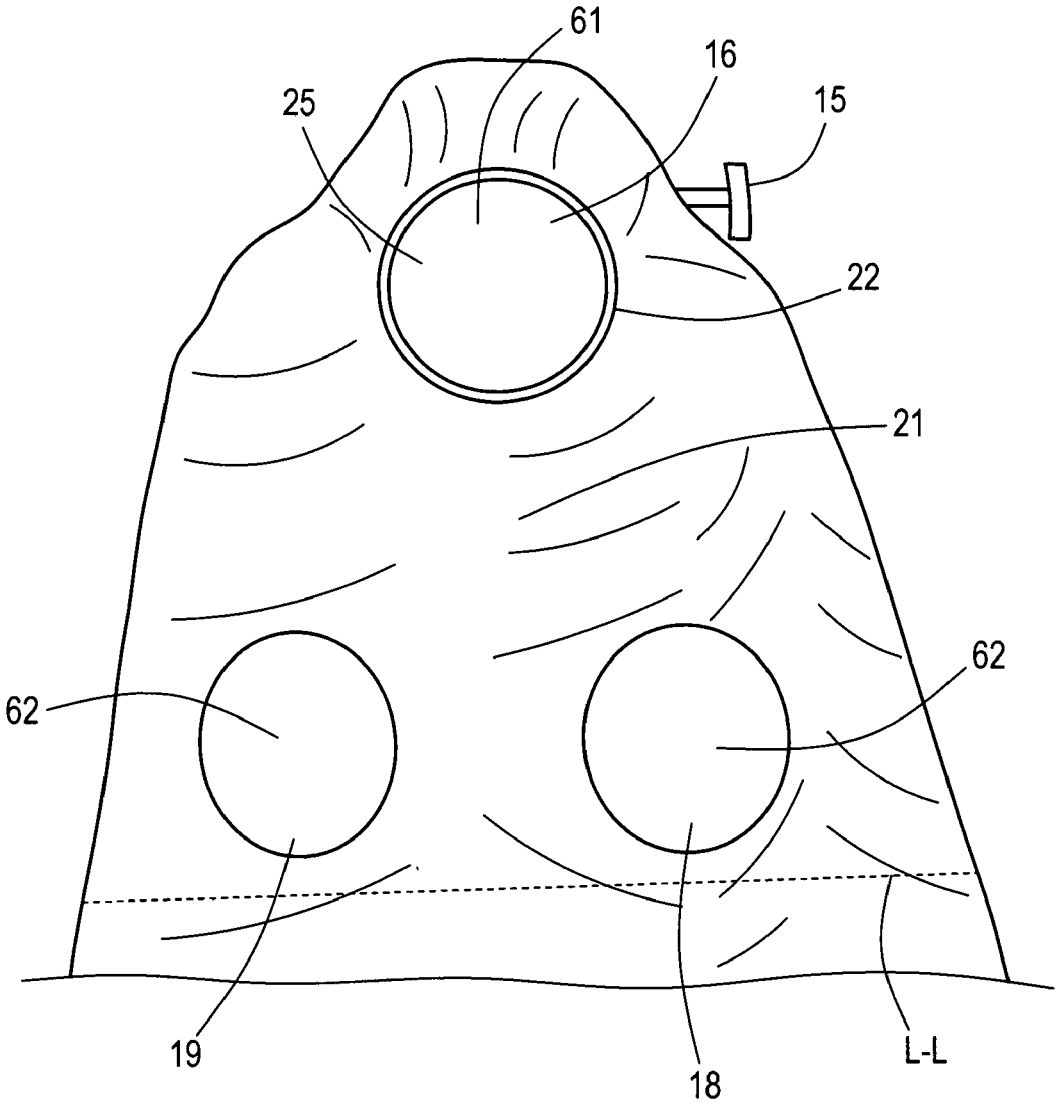
FIG. 3 depicts a close-up rear view of the exemplary helmet of FIG. 1.

FIG. 3 provides a rear close-up view of exemplary helmet 10. As shown in FIG. 3, a first air filtration material 61 forms hood air inlet 16 of exemplary hood 12, and a second air filtration material 62 forms hood air outlets 18 and 19 of exemplary hood 12. First air filtration material 61 and second air filtration material 62 may comprise a variety of filtration materials. Typically, each of first and second air filtration materials 61 and 62 comprises a nonwoven fabric, such as a spunbonded fabric, a spunlaced fabric, a needle-punched fabric, a melt-blown fabric, or any combination thereof. In one desired embodiment, each of first and second air filtration materials 61 and 62 comprises a spunbonded fabric, such as a nylon spunbonded fabric commercially available under the trade designation CEREX® from Cerex Advanced Fabrics, Inc. (Pensacola, Fla.).

Typically, each of first and second air filtration materials 61 and 62 comprises a nonwoven fabric having a fabric basis weight of less than 100 grams per square meter (gsm) (more typically, from about 9 gsm to about 95 gsm, even more typically, from about 15 gsm to about 50 gsm) and a fabric thickness of less than about 150 microns (μm), typically, from about 75 μm to about 100 μm.

The remaining portions of hood 12 (i.e., all of hood 12 other than hood air inlet 16 and hood air outlets 18 and 19) typically comprise a fluid/blood barrier material. The fluid/blood barrier material typically comprises a nonwoven fabric or nonwoven fabric/film laminate and is used to form the remaining portions of hood 12. In one desired embodiment, the fluid/blood barrier material comprises any breathable viral barrier (BVB) fabric commercially available from Ahlstrom Corporation (Alpharetta, Ga.), such as a BVB trilaminate polypropylene material.

Figure 4:
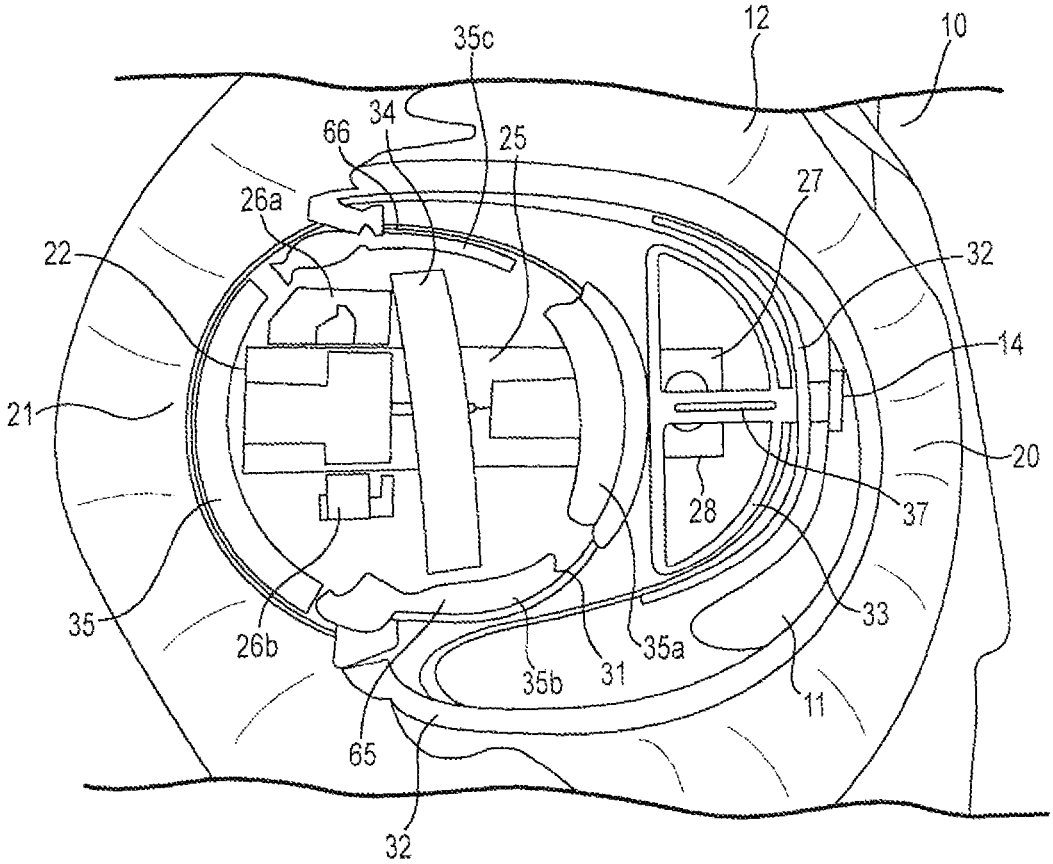
FIG. 4 depicts a view of the exemplary helmet of FIG. 1 when viewed from below the helmet.

FIG. 4 provides a view of exemplary helmet 10 of FIG. 1 when viewed from below helmet 10 (e.g., when viewed from position V shown in FIG. 1). As shown in FIG. 4, exemplary helmet 10 comprises frame 30, which is operatively adapted to surround at least a portion of a person's head (not shown). Frame 30 typically comprises one or more frame components. In exemplary helmet 10, frame 30 comprises the following frame components: adjustable frame component 31, which extends around at least a portion of a person's head and can be adjusted in length and width dimensions using knob 14 as described above; frame component 32, which at least partially surrounds transparent face shield 11 and attaches transparent face shield 11 to other helmet components; frame component 33, which extends along a front side 20 of exemplary helmet 10 and connects adjustable frame component 31 to frame component 32; knob extension member 37 extending along a portion of frame component 33 and being rotatably connected to knob 14; and frame component 34, which extends from a first location 65 along adjustable frame component 31 to a second location 66 along adjustable frame component 31 and is operatively adapted to conform to an outer contour of a person's head.

As shown in FIG. 4, exemplary helmet 10 may further comprise pads 35*a*, 35*b*, and 35*c* positioned along one or more of the above-described frame components. As shown in FIG. 4, exemplary helmet 10 comprises multiple pads 35*a*, 35*b*, and 35*c* positioned along adjustable frame component 31 and a single pad 35*d* (shown in FIG. 5) positioned along frame component 34.

Figure 5:
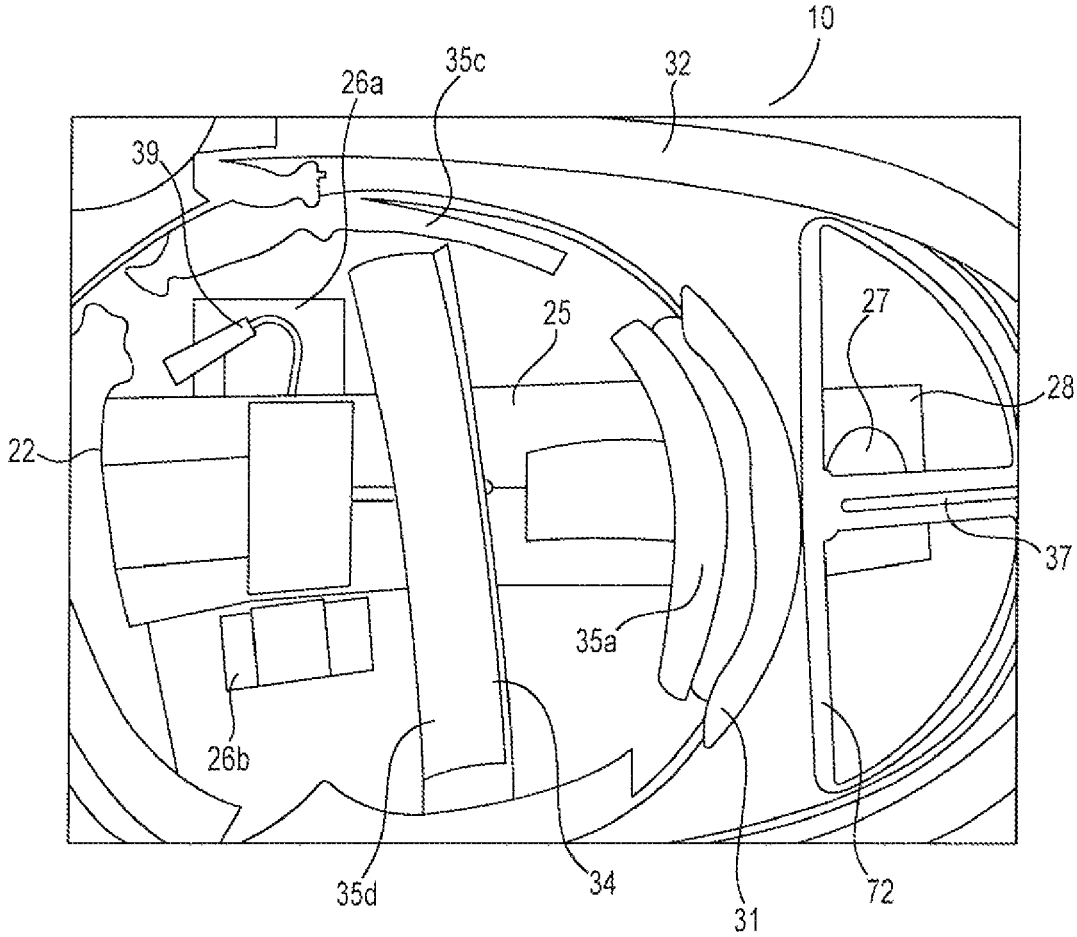
FIG. 5 depicts a close-up view of the frame, air channel, battery pack, and fan of the exemplary helmet of FIG. 1 when viewed from below the helmet.

FIG. 4 provides a view of a battery pack 26 that is present in some helmets of the present invention. As shown in FIG. 4, exemplary battery pack 26 comprised of two portions designated as 26*a* and 26*b* in FIGS. 4 and 5 is positioned along opposite sides of air channel 25. Electrical wiring (not shown) connects battery pack 26 to fan 27 and power switch 23 (shown in FIGS. 2 and 6). Although shown on opposite sides of air channel 25, it should be understood that battery pack 26 may be located along any portion of frame 30. Desirably, as shown in FIGS. 4-6, battery pack 26 is located above a lower edge of the transparent face shield, more desirably, above an upper portion of the transparent face shield and along one or both sides of air channel 25.

FIG. 5 provides a close-up view of various helmet components within exemplary helmet 10. As shown in FIG. 5, exemplary helmet 10 comprises air channel 25 extending between air inlet 22 and air outlet 28. Battery pack 26 comprised of two portions designated as 26*a* and 26*b* in FIGS. 4 and 5 is positioned along opposite sides of air channel 25. Electrical wiring 39 connects battery pack 26*a* and 26*b* to fan 27 and power switch 23 (shown in FIGS. 2 and 6). As shown in FIG. 5, fan 27 is positioned within air channel 25 in the vicinity of air outlet 28. However, it should be understood that fan 27 may be positioned at any location within air channel 25 or at air inlet 22. Damper 72 is positioned adjacent wall 73 of second frame component 33 in an "up" position, but can be rotated into a "down" position away from wall 73 and over air outlet 28 to block and/or redirect air flow through helmet 10. The degree of air blockage and air flow direction can be controlled by rotating knob 15 as discussed above.

Figure 6A:
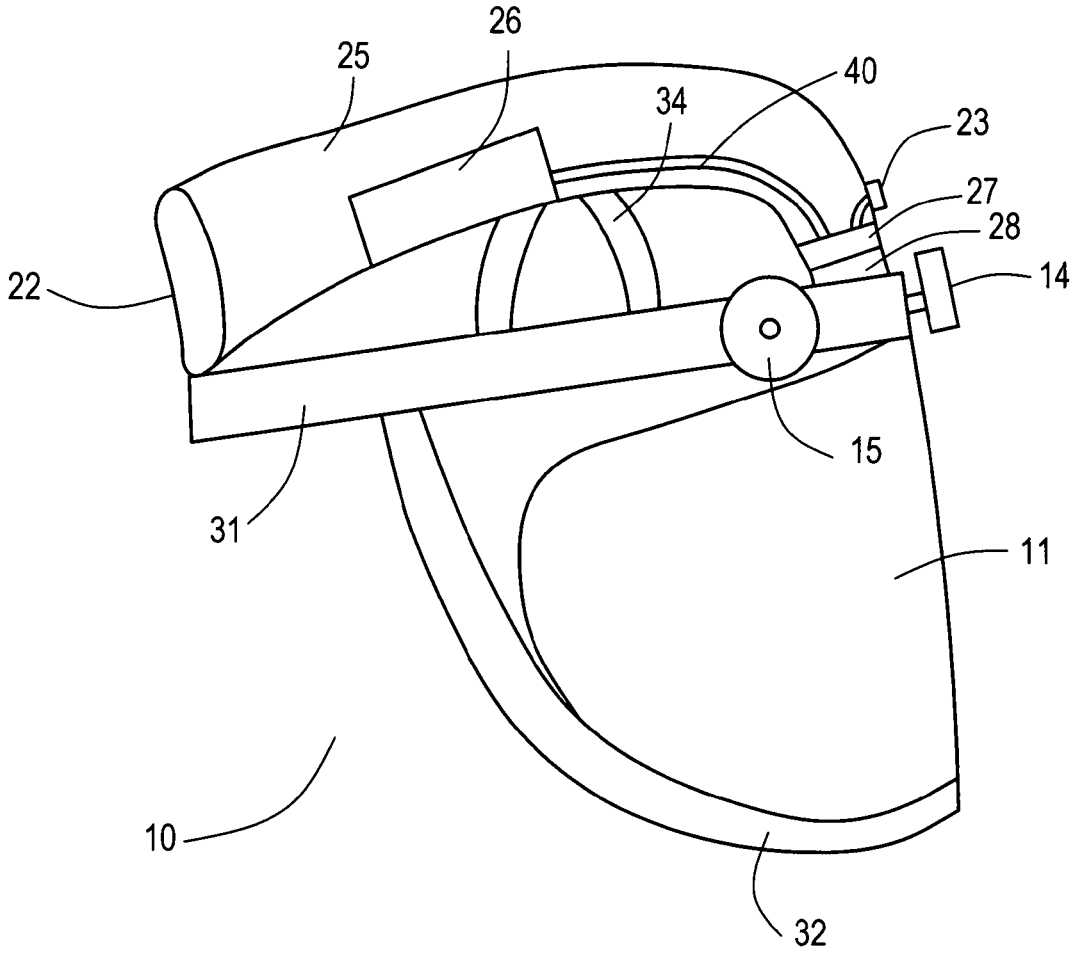
FIG. 6A depicts a side view of the exemplary helmet of FIG. 1 when the hood is removed.

FIG. 6A provides a side view of exemplary helmet 10 of FIG. 1 when hood 12 is removed. As shown in FIG. 6A, exemplary helmet 10 comprises adjustable frame component 31 dimensioned so as to extend around at least a portion of a person's head; knobs 14 and 15, which are operatively adapted to adjust dimensions of adjustable frame component 31 and air flow through the helmet respectively; first frame component 32 partially surrounding transparent face shield 11; third frame component 34, which is operatively adapted to conform to an outer contour of a person's head; battery pack 26; fan 27; air channel 25; air inlet 22; air outlet 28; electrical wiring 40 connecting battery pack 26 to fan 27; and power switch 23.

Figure 6B:
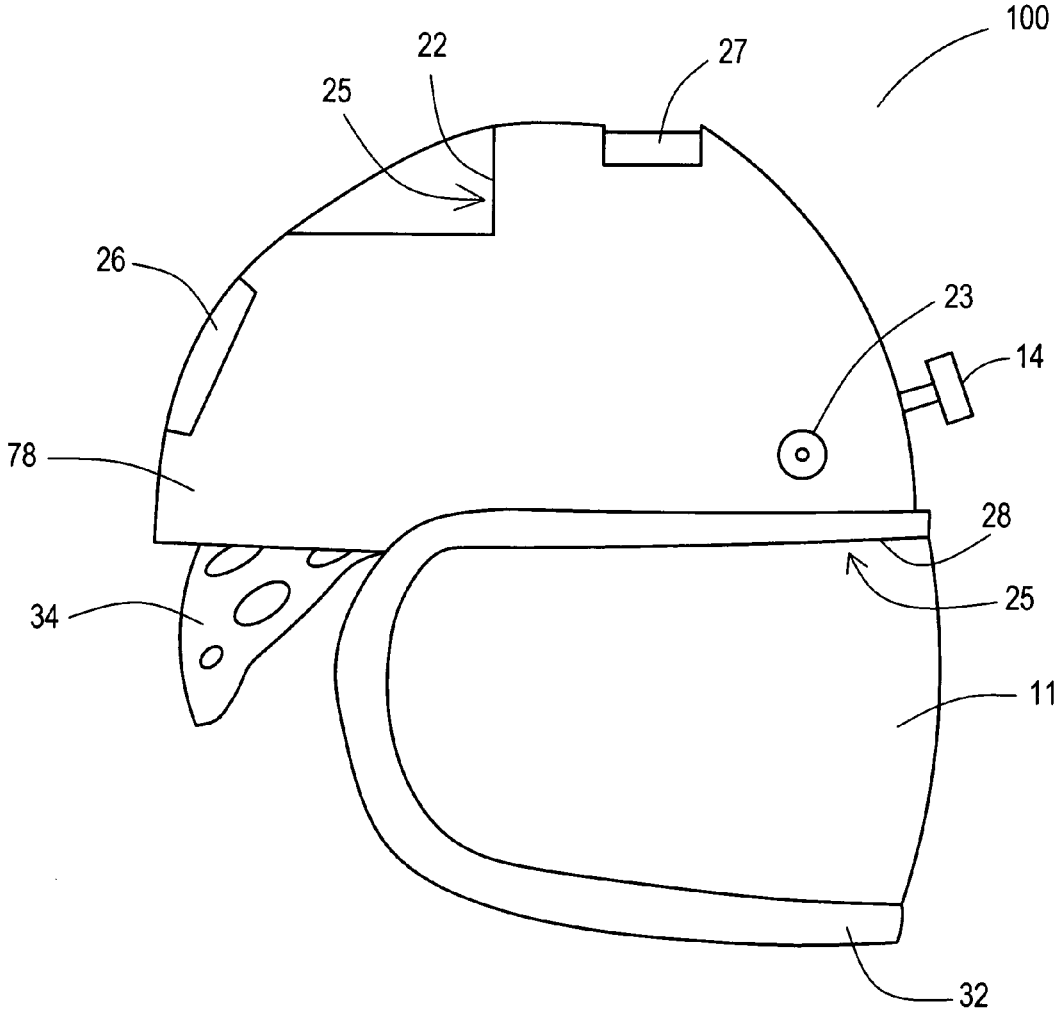
FIG. 6B depicts a side view of another exemplary helmet shown without a hood component.

FIG. 6B provides a side view of another exemplary helmet 10 without a hood component. As shown in FIG. 6B, exemplary helmet 100 comprises molded helmet component 78; knob 14, which is operatively adapted to adjust dimensions of a frame component (not shown but similar to adjustable frame component 31 shown in FIG. 6A) extending around at least a portion of a person's head; first frame component 32 partially surrounding transparent face shield 11; third frame component 34, which is operatively adapted to conform to an outer contour of a person's head; battery pack 26; fan 27; air channel 25; air inlet 22; air outlet 28; electrical wiring connecting battery pack 26 to fan 27 (not shown, but typically within or along an inner surface of helmet component 78); and power switch/knob 23, which is operatively adapted to provide electricity to the fan and adjust the fan speed (i.e., air flow through the helmet).

As shown in FIG. 6B, fan 27 can be positioned near air inlet 22 of air channel 25. Further, battery pack 26 can be positioned along a rear outer surface of helmet component 78. Although power switch/knob 23 is shown as a single switch/knob on exemplary helmet 100, it should be understood that a separate on/off switch and a separate air speed control knob could be present on exemplary helmet 100. As discussed above, multiple air inlets 22 and/or air outlets 28 could be utilized on exemplary helmet 100 to provide air flow through exemplary helmet 100. Further, one or more air inlets 22 and/or air outlets 28 can be positioned on exemplary helmet 100 in any desired locations so as to provide air flow through exemplary helmet 100.

In one exemplary embodiment, any of the above-described helmets are sterilized prior to use. For example, in an operating room setting, a sterile field must be maintained around a surgical procedure site. Consequently, a surgical helmet used during such a surgical procedure must be sterilized prior to use.

Typically, the helmets of the present invention are disposable. However, in some cases, the helmets of the present invention may be reusable. When reused, the helmet may need to be subjected to a cleaning procedure and/or sterilization procedure prior to reuse.

Figure 7:
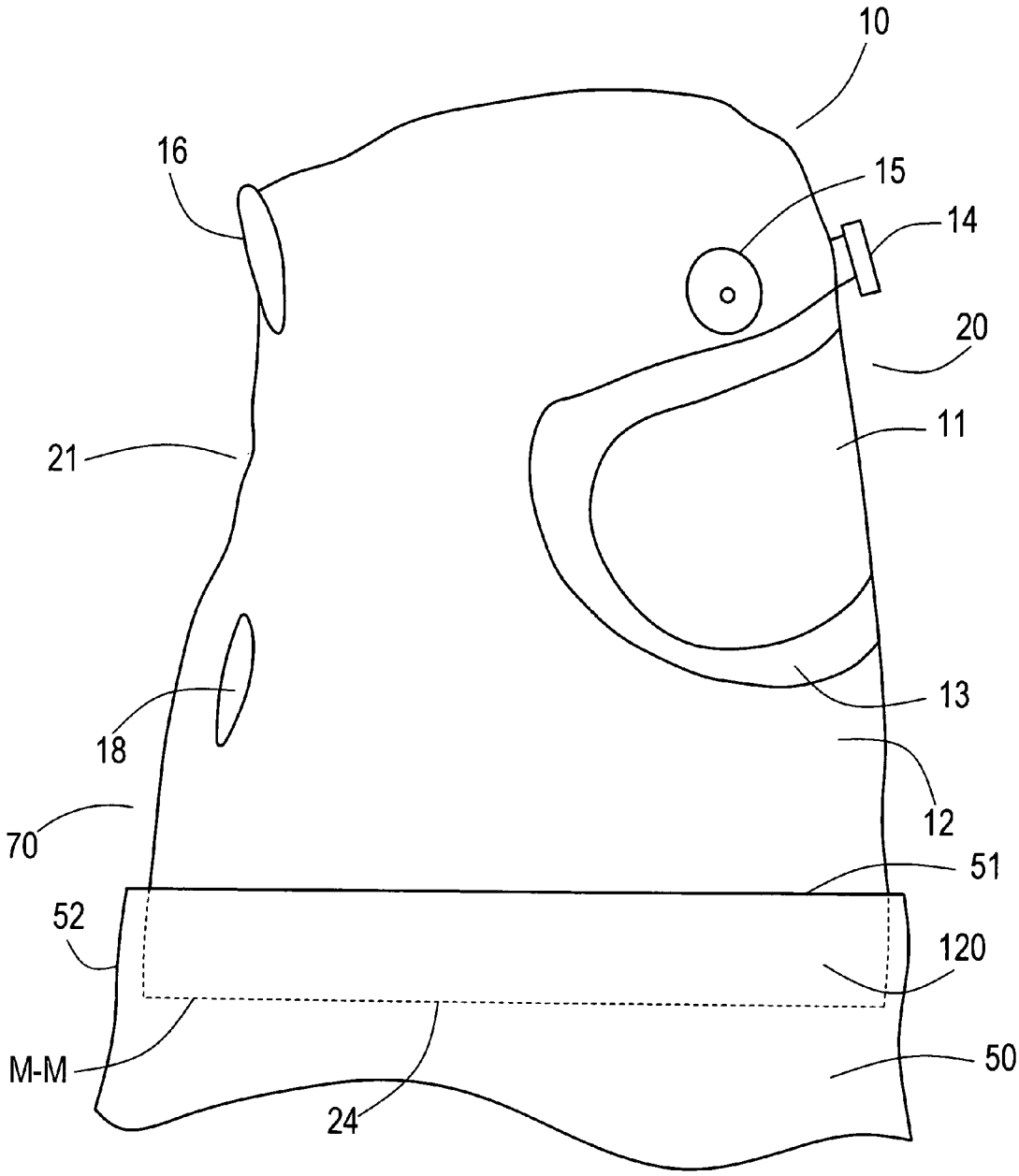
FIG. 7 depicts an exemplary surgical outfit comprising the exemplary helmet of FIG. 1 in combination with a surgical gown.

The present invention is also: directed to a surgical outfit comprising at least one helmet. An exemplary surgical outfit is shown in FIG. 7. As shown in FIG. 7, exemplary surgical outfit 70 comprises exemplary helmet 10 (or exemplary helmet 100) in combination with surgical gown 50. Surgical gown 50 is sized so as to extend from a neck region of a user to a waist region of the user or below. Hood 12 of helmet 10 is sized so as to extend below the neck region of the user. In one desired configuration shown in FIG. 7, a lower portion 120 of hood 12 (outlined with dash line M-M) is tucked within an upper portion 52 of surgical gown 50. Desirably, when at least one air outlet 18 is present in hood 12, the at least one air outlet 18 is positioned above upper edge 51 of surgical gown 50. In such a configuration, upper portion 52 of surgical gown 50 effectively blocks air flow into surgical gown 50 and out through the at least one air outlet 18.

It should be noted that helmets 10 and 100 as shown in FIGS. 1-7 are only two exemplary helmets of the present invention. Various modifications could be made to exemplary helmets 10 and 100 including, but not limited to, increasing the number of hood air inlet(s) 16 and/or the number of hood air outlets 18 and 19; increasing or decreasing the size of one or more components (e.g., transparent face shield 11 and/or hood air inlet(s) 16 and/or hood air outlets 18 and 19) relative to other components (e.g., hood 12); and rearranging one or more components of exemplary helmets 10 and 100 (e.g., changing the position of fan 27 to a position closer to air inlet 22 and/or changing the position of hood air outlets 18 and 19 so as to be closer to transparent face shield 11 and/or further away from hood air inlet(s) 16).

Typically, helmets of the present invention comprise from one to about five hood air inlet(s) 16, from one to about five hood air outlets 18 and 19, a single fan 27, and a single air channel 25; however, helmets of the present invention could comprise, for example, multiple fans and/or multiple air channels.

II. Methods of Making Helmets

The present invention is further directed to methods of making helmets. In one exemplary embodiment, the method of making a helmet comprises providing a frame of a helmet, the frame being operatively adapted to surround at least a portion of a person's head; attaching a transparent face shield to the frame so as to be positioned along a front side of the helmet; providing an air channel having at least one air inlet and at least one air outlet the air channel being attached to or integrally formed into the frame; providing a fan in fluid communication with the air channel, the fan being operatively adapted to move air through the air channel; incorporating a battery pack into the helmet, the battery pack being operatively adapted to supply electrical power to the fan; and providing a hood that surrounds the transparent face shield and extends over and downward from the frame. Desirably, the at least one air outlet is positioned so as to provide air to a space bound by an inner surface of the transparent face shield. In other desired embodiments, the battery pack is positioned above a lower edge of the transparent face shield, more desirably, above an upper edge of the transparent face shield.

In another exemplary embodiment, the method of making a helmet comprises providing a frame of a helmet, the frame being operatively adapted to surround at least a portion of a person's head; attaching a transparent face shield to the frame so as to be positioned along a front side of the helmet; providing an air channel having at least one air inlet and at least one air outlet, the air channel being attached to or integrally formed into the frame; providing a fan in fluid communication with the air channel, the fan being operatively adapted to move air through the air channel; and attaching a hood to the frame so as to surround the transparent face shield and extend over and downward from the frame, the hood comprising (i)

at least one hood air inlet located within a periphery of the hood and aligned with the at least one air inlet of the air channel, and (ii) at least one hood air outlet located within a periphery of the hood, wherein the at least one hood air inlet and the at least one hood air outlet are operatively adapted to provide air flow through the helmet so as to decrease an amount of carbon dioxide buildup within the helmet. Desirably, the at least one air outlet is positioned so as to provide air to a space bound by an inner surface of the transparent face shield.

Any of the above-described individual components used to form the helmets of the present invention may be formed using conventional methods. For example, helmet components including, but not limited to, adjustable frame component 31, first frame component 32, second frame component 33, third frame component 34, knob extension member 37, knobs 14 and 15, air channel 25, and transparent face shield 11, may be formed from any thermoformable material including, but not limited to, polymeric materials, metallic materials, or a combination thereof. The thermoformable materials can be molded or shaped using any conventional molding technique. Typically, the above-mentioned helmet components are formed from polymeric materials such as polyolefins (e.g., polyethylene, polypropylene, and olefin copolymers), polyurethanes, acrylonitrile-butadiene-styrene (ABS) copolymers, polyesters, polyethylene terephthalate glycol (PETG), polyamides, etc.

Any films or film-like components including, but not limited to, adjustable frame component 31 and third frame component 34, may be forming via any film-forming process including, but not limited to, a film extrusion process, a film-blowing process, etc.

Fiber-containing helmet components, such as hood 12 and first and second air filtration materials 61 and 62, may be formed using conventional web-forming processes including, but not limited to, meltblowing processes, spunbonding processes, spunlacing processes, hydroentangling processes, carding processes, needlepunching processes, etc. Typically, the fiber-containing helmet components are formed from polymeric materials such as polyolefins (e.g., polyethylene, polypropylene, and olefin copolymers), nylon, acrylonitrile-butadiene-styrene (ABS) copolymers, etc.

Thermoformed parts, films and/or fabric layers may be joined to one another using any conventional bonding technique including, but not limited to, thermal bonding processes, adhesive bonding, mechanical bonding (e.g., hook and loop material), etc. In one exemplary embodiment of the present invention, the hood is formed from an Ahlstrom Corporation BVB Material (e.g., trilaminate polypropylene material) and is thermally bonded to an outer periphery of a transparent face shield formed from PETG using a conventional thermal-bonding apparatus (e.g., an ultrasound welder).

In one desired embodiment, the helmet of the present invention is formed from the following materials: a closed cell polyurethane foam molded helmet component (e.g., helmet component 78); frame components (e.g., adjustable frame component 31 shown in FIG. 6A) formed from polyethylene; a transparent face shield (e.g., transparent face shield 11) formed from PETG; a frame component extending around the transparent face shield (e.g., frame component 32) formed from polyvinyl chloride (PVC); head band material in the form of VELCRO® brand terry cloth; batteries—4 AAA Alkaline batteries; and air inlet and outlet material formed from CEREX® nylon spunbonded fabric.

III. Methods of Using Helmets in an Operating Room Setting

The present invention is further directed to methods of using the above-described helmets in an operating room setting. In one exemplary embodiment, the method comprises a method of providing a barrier between a surgeon (or other operating room personnel) and a patient in an operating room setting, wherein the method comprises the step of positioning the helmet over at least a portion of the surgeon's head (or any other operating room personnel's head) to separate the surgeon (or other operating room personnel) from a surgical procedure site. Typically, the helmet is used in combination with a surgical gown and other pieces of protective clothing (e.g., booties, gloves, etc.) to provide a barrier between the surgeon and a surgical procedure site.

In another exemplary embodiment, the present invention is directed to a method of reducing an amount of carbon dioxide within a surgical outfit during use. In this exemplary embodiment, the method comprises (A) providing a surgical outfit comprising (1) a helmet comprising (i) a frame operatively adapted to surround at least a portion of a person's head; (ii) a transparent face shield attached to the frame and positioned along a front side of the helmet; (iii) an air channel having at least one air inlet and at least one air outlet, the at least one air outlet being positioned so as to provide air to a space bound by an inner surface of the transparent face shield; and (iv) a fan in fluid communication with the air channel, the fan being operatively adapted to move air through the air channel; and (2) a hood or surgical gown surrounding the transparent face shield and extending over and downward from the frame, the hood or surgical gown comprising (i) at least one air inlet located within a periphery of the hood or surgical gown and aligned with the at least one air inlet of the air channel, and (ii) at least one air outlet located within a periphery of the hood or surgical gown; and (B) cutting on the fan to provide air flow along a path through the surgical outfit components in the following order: an air inlet in a surgical gown, at least one hood air inlet in a helmet, to at least one air inlet, through an air channel, out of at least one air outlet into a region of the helmet bound by a transparent face shield, out of the helmet through at least one hood air outlet, and out of the surgical gown through at least one air outlet in the surgical gown.

In one desired embodiment, the method of reducing an amount of carbon dioxide within a surgical outfit during use results in a carbon dioxide level of less than about 5000 ppm, more desirably, less than about 4000 ppm, even more desirably, less than about 3500 ppm, and even more desirably, less than about 3000 ppm (or less than about 2500 ppm, or less than about 2000 ppm, or less than about 1800 ppm).

The surgical outfit of the present invention also improves air flow through the surgical outfit. For example, air flow through a surgical outfit without at least one hood air outlet may be in the range of about 2.5 to about 3.4 cubic feet per minute (cfm), while air flow through a surgical outfit of the present invention with at least one hood air outlet can be in the range of about 3.9 to about 5.5 cfm, an increase in air flow of as much as 120%.

In some embodiments, the above-described methods may further comprise one or more of the following steps: sterilizing the helmet prior to use, removing the helmet from a packaging material, adjusting the helmet frame to fit snugly on the surgeon's head, checking the power supply to insure the fan is operational, combining the helmet with other pieces of protective clothing, tucking a portion of the hood of the helmet within a surgical gown, and turning on the power supply for the fan.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A helmet comprising:

a frame operatively adapted to surround at least a portion of a person's head;

a transparent face shield attached to the frame and positioned along a front side of said helmet;

an air channel having at least one air inlet and an air outlet consisting of a single air outlet, said single air outlet being positioned so as to provide air to a space bound by an inner surface of the transparent face shield;

a fan in fluid communication with the air channel, said fan being operatively adapted to move air through said air channel;

a battery pack attached to the frame and positioned above a lower edge of the transparent face shield and along opposite sides of the air channel, said battery pack being operatively adapted to supply electrical power to the fan; and a hood surrounding the transparent face shield and extending over and downward from the frame.

2. The helmet of claim 1, further comprising:

at least one hood air inlet located within a periphery of the hood and aligned with the at least one air inlet of the air channel.

3. The helmet of claim 1, wherein the at least one hood air inlet is positioned along an outer surface of the helmet opposite the transparent face shield.

4. The helmet of claim 1, further comprising:

at least one hood air inlet located within a periphery of the hood and aligned with the at least one air inlet of the air channel; and at least one hood air outlet located within a periphery of the hood, wherein the at least one hood air inlet is positioned along an outer surface of the helmet, and the at least one hood air outlet is positioned below the at least one hood air inlet.

5. The helmet of claim 1, further comprising:

a power switch operatively adapted to (1) switch from an "off" position to an "on" position so as to supply power to the fan and turn off power to the fan, and optionally (2) provide variable speed settings for the fan.

6. The helmet of claim 5, wherein the power switch is positioned along an upper periphery of the transparent face shield.

7. The helmet of claim 1, wherein the battery pack is positioned along an outer surface of the helmet opposite the transparent face shield.

8. A surgical outfit comprising:

the helmet of claim 1; and a surgical gown sized so as to extend from a neck region of a user to a waist region or below, wherein the hood of the helmet is sized so as to extend below the neck region of the user, and when a lower portion of the hood is tucked within an upper portion of the surgical gown, the at least one air outlet of the hood is positioned above the surgical gown.

9. A helmet comprising:

a frame operatively adapted to surround at least a portion of a person's head;

a transparent face shield attached to the frame and positioned along a front side of said helmet;

an air channel having at least one air inlet and an air outlet consisting of a single air outlet, said single air outlet being positioned so as to provide air to a space bound by an inner surface of the transparent face shield;

a fan in fluid communication with the air channel, said fan being operatively adapted to move air through said air channel;

a battery pack attached to the frame and positioned above a lower edge of the transparent face shield and along opposite sides of the air channel, said battery pack being operatively adapted to supply electrical power to the fan;

a hood surrounding the transparent face shield and extending over and downward from the frame;

at least one hood air inlet located within a periphery of the hood and aligned with the at least one air inlet of the air channel; and at least one hood air outlet located within a periphery of the hood, wherein the at least one hood air inlet and the at least one hood air outlet are operatively adapted to provide air flow through the helmet so as to decrease an amount of carbon dioxide buildup within the helmet.

10. The helmet of claim 9, wherein the at least one hood air inlet is positioned along a rear side of the helmet opposite the transparent face shield, and the at least one hood air outlet is positioned below the at least one hood air inlet.

11. The helmet of claim 9, wherein the at least one hood air inlet comprises a single hood air inlet, and the at least one hood air outlet comprises one or more air outlets positioned along a neck region of the hood.

12. The helmet of claim 9, wherein each of the hood, the at least one hood air inlet, and the at least one hood air outlet comprises nonwoven fabric materials.

13. The helmet of claim 9, wherein the helmet is sterilized.

14. The helmet of claim 9, wherein the helmet is disposable.

15. A method of making a helmet suitable for use in an operating room setting, said method comprising:

providing a frame of a helmet, the frame being operatively adapted to surround at least a portion of a person's head;

attaching a transparent face shield to the frame so as to be positioned along a front side of the helmet;

providing an air channel having at least one air inlet and one air outlet, the one air outlet being positioned so as to provide air to a space bound by an inner surface of the transparent face shield, the air channel being attached to or integrally formed into the frame;

providing a fan in fluid communication with the air channel, the fan being operatively adapted to move air through the air channel;

incorporating a battery pack into the helmet so as to be positioned above a lower edge of the transparent face shield and along opposite sides of the air channel, the battery pack being operatively adapted to supply electrical power to the fan; and providing a hood that surrounds the transparent face shield and extends over and downward from the frame.

16. The method of claim 15, wherein the hood comprises:

at least one hood air inlet located within a periphery of the hood and aligned with the at least one air inlet of the air channel; and one hood air outlet located within a periphery of the hood, wherein the at least one hood air inlet and the one hood air outlet are operatively adapted to provide air flow through the helmet so as to decrease an amount of carbon dioxide buildup within the helmet.

17. A method of reducing an amount of carbon dioxide within a surgical outfit during use, said method comprising:

providing a surgical outfit comprising:

a helmet comprising:

a frame operatively adapted to surround at least a portion of a person's head;

a transparent face shield attached to the frame and positioned along a front side of said helmet;

an air channel having at least one air inlet and one air outlet, said one air outlet being positioned so as to provide air to a space bound by an inner surface of the transparent face shield;

a fan in fluid communication with the air channel, said fan being operatively adapted to move air through said air channel;

a battery pack attached to the frame and positioned above a lower edge of the transparent face shield and along opposite sides of the air channel, said battery pack being operatively adapted to supply electrical power to the fan; and a hood surrounding the transparent face shield and extending over and downward from the frame; and a surgical gown sized so as to extend from a neck region of a user to a waist region or below, wherein the hood of the helmet is sized so as to extend below the neck region of the user, and when a lower portion of the hood is tucked within an upper portion of the surgical gown, the at least one air outlet of the hood is positioned above the surgical gown; and cutting on the fan to provide an air flow path into the at least one hood air inlet, to the at least one air inlet, through the air channel, out of the at least one air outlet into a region of the helmet bound by the transparent face shield, and out of the helmet through the at least one hood air outlet.

18. The method of claim 17, wherein the amount of carbon dioxide within the surgical outfit during use is below 2500 parts per million.

* * * * *